United States Patent [19]

Evans

[11] 4,440,384

[45] Apr. 3, 1984

[54] RETORT PIPE SEAL

[75] Inventor: Harmon A. Evans, Ogden, Utah

[73] Assignee: Westinghouse Electric Corp., Pittsburgh, Pa.

[21] Appl. No.: 184,686

[22] Filed: Sep. 8, 1980

[51] Int. Cl.[3] ..... C21B 7/22

[52] U.S. Cl. ..... 266/149; 75/61; 75/63; 75/65 R

[58] Field of Search ..... 75/63, 65, 61; 266/149

[56] References Cited

U.S. PATENT DOCUMENTS

| | | | |
|---|---|---|---|
| 3,039,866 | 6/1962 | Takeuchi | 266/149 |
| 3,158,671 | 11/1964 | Socci | 266/149 |
| 3,767,381 | 10/1973 | Bielefeldt | 75/65 R |
| 3,948,495 | 4/1976 | Cherednichenko | 75/63 |
| 4,105,192 | 8/1978 | Ishimatsu | 266/149 |
| 4,146,774 | 3/1979 | Fraas | 266/149 |

*Primary Examiner*—Peter D. Rosenberg
*Attorney, Agent, or Firm*—L. P. Johns

[57] ABSTRACT

A retort pipe seal characterized by a retort and a crucible and passage means therebetween; a closure diaphragm for closing said means; means for heating the crucible; and rupture means for rupturing the closure diaphragm to enable a reactant in the retort to transfer to the crucible at a predetermined temperature.

7 Claims, 2 Drawing Figures

RETORT PIPE SEAL

CROSS-REFERENCE TO RELATED APPLICATIONS

This application is related to the copending applications of Harmond Evans, Ser. No. 184,683, filed Sept. 8, 1980, now abandoned; and Ser. No. 184,684, filed Sept. 8, 1980.

BACKGROUND OF THE INVENTION

1. Field of the Invention

This invention relates to a seal for a pipe communicating between a pair of receptacles containing reactants to be mixed at a predetermined temperature.

2. Description of the Prior Art

In the production of materials which involve chemical compounds as reactants, the results may be highly inefficient if critical conditions are not adhered to. This is particularly true where one of the reactants vaporizes at a temperature lower than a required higher temperature of operation. Under such conditions, it frequently happens that the resulting product is contaminated with the same or related impurities which are attempting to be eliminated. This has resulted in costly alternative procedures for eliminating these impurities.

SUMMARY OF THE INVENTION

It has been found in accordance with this invention that problems of prior procedures may be overcome by the apparatus of the present invention. This apparatus for reacting chemicals comprises a retort for containing a first reactant such as zirconium tetrachloride, a crucible for containing a second reactant such as magnesium, a passage interconnecting the retort and crucible, a furnace for heating the crucible to a predetermined temperature, a diaphragm closing the passage for preventing vaporized zirconium tetrachloride from reacting with magnesium at a temperature lower than a temperature range of from about 650° C. to 700° C., and means for removing the diaphragm when the prescribed temperature range is achieved, to effect a maximum production of zirconium sponge.

The advantage of the apparatus and process of this invention is that the intended product, zirconium sponge, contains a minimal amount of side products and impurities.

DESCRIPTION OF THE PREFERRED EMBODIMENT

Figure 1:
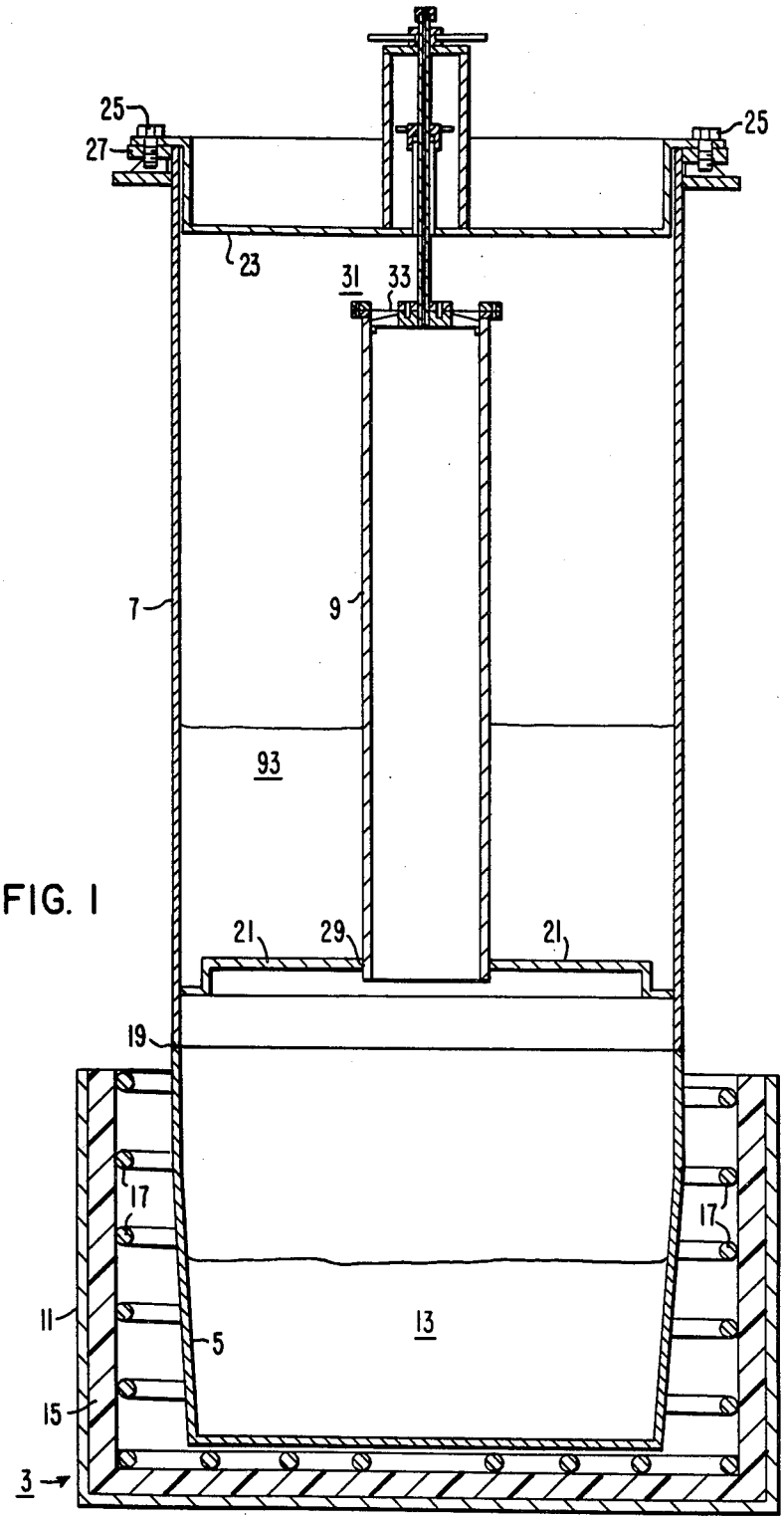
FIG. 1 is a vertical sectional view of the structure by which zirconium tetrachloride is reduced to zirconium sponge in accordance with this invention.

Apparatus is generally indicated at 3 in FIG. 1 for reducing a metal compound to elemental metal. It comprises a crucible 5, a retort 7, opening means or conduit 9, and a furnace 11. Although the apparatus 3 is preferably used as a reduction plant for reacting zirconium tetrachloride with elemental magnesium to form zirconium sponge and magnesium chloride, the apparatus may be used for the conversion of other reactants requiring similar reacting conditions as set forth below, notably titanium.

The crucible 5 in which the reaction occurs is a cup-shaped receptacle and may have an inside liner of, for example, stainless steel (not shown). Elemental magnesium 13 in the form of pigs or particles is disposed in the crucible. The crucible 5 is located in the furnace 11 having an insulative liner 15 and spaced heating elements 17. The purpose of the furnace 11 is to maintain the magnesium 13 in a molten state in a temperature range of from about 650° C. to about 700° C., which includes the melting point of magnesium of 651° C.

The retort 7 is a cylindrical member in registry with the crucible 5 and usually having its lower end secured to the upper end of the crucible 5 by a peripheral weld 19 to ensure an air-tight atmosphere within the crucible 5. The retort 7 includes a bottom wall 21 and a cover 23 which by suitable means, such as spaced bolts 25, is secured in an air-tight manner on an upper peripheral flange 27 of the retort.

Communication between the retort 7 and the crucible 5 is provided by the passageway or conduit 9 which is substantially centrally situated in the retort 7 and the lower end of which is secured by a welded joint 29 in the bottom wall 21. The upper end of the conduit 9 comprises closure means generally indicated at 31 which is detachable to enable opening of the conduit 9 when proper temperature conditions are obtained.

In accordance with this invention, the closure means 31 comprises a diaphragm 33 of metal, such as light gauge steel. The diaphragm 33 (FIG. 2) is secured tightly in place around the periphery at the upper end of the conduit 9 between a peripheral flange 35 mounted at the upper end of the conduit and a clamping ring 37 which is secured in place by suitable means, such as spaced bolts 39. The flange 35 and the ring 37 include mutually interfitting tongue and groove members 41, 42, respectively, for securing the peripheral portion of the diaphragm 33 tightly in place.

Figure 2:
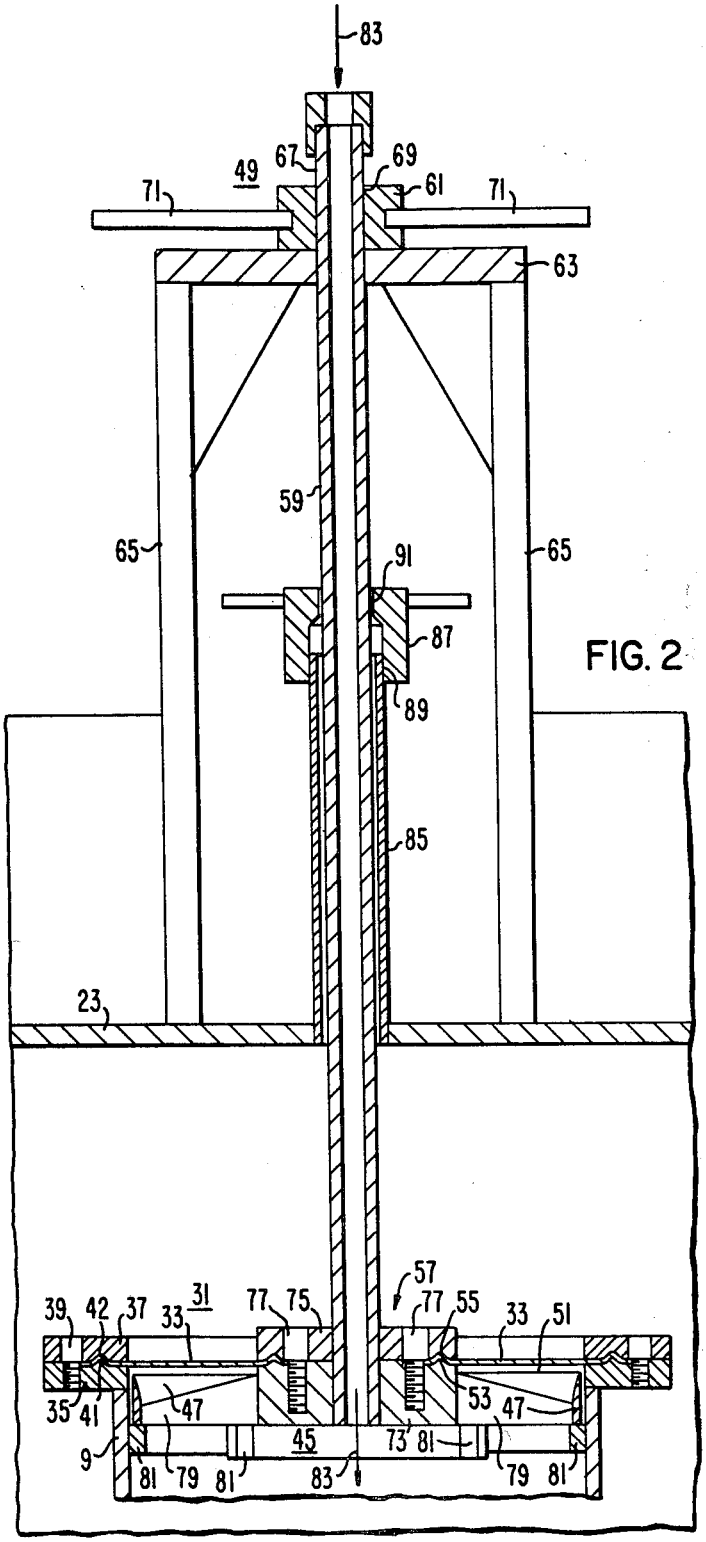
FIG. 2 is an enlarged vertical sectional view of a portion of the structure of FIG. 1.

Means for opening the closure means 31 to enable interaction of the reactants in the retort 7 and the crucible 5 are generally indicated at 45 (FIG. 2). The means 45 comprises a circular knife or blade 47 and lifting means generally indicated at 49 (FIG. 2). The blade 47 is an annulus having an upper cutting edge 51 facing the undersurface of the diaphragm 33. When the blade 47 is raised, the diaphragm 33 being clamped between the tongue and groove 41, 42 at the periphery and a similar tongue and groove 53, 55 in a hub assembly 57, is severed, whereby the closure means 31 is broken and permits communication between the retort 7 and the crucible 5.

The lifting means 49 comprises an elongated tube 59 and a nut 61. The lifting means is supported on an elevated platform 63 supported on spaced upright 65 extending from the cover 23. The upper end portion of the tube 59 is threaded at 67 which thread is engaged by a thread 69 on the nut 61. The nut includes radially extending handles 71 by which the nut 61 is turned to raise and lower the tube 59, whereby the blade 57 is raised and lowered to and from the diaphragm 33. The hub assembly 57 is secured to the lower end of the tube 59 and comprises a hub 73 and a clamping plate 75 which are secured together by suitable means such as a plurality of bolts 77. As shown in FIG. 2, the tongue and groove 53, 55 are disposed in the hub 73 and plate 75, respectively, for securing the inner periphery of the diaphragm 33 tightly in place.

The annular blade 47 is secured in place by spokes 79 which extend radially from the hub 73. In the retracted position, the blade 47 is supported on blocks 81 on the inner surface of the conduit 9.

The tube 59 is open at the upper end to enable introduction of an inert gas, such as helium or argon, as indicated by an arrow 83 which gas moves out of the lower end of the tube 59 and into the conduit 9 from which it moves into the crucible 13. For that purpose, a gas-tight joint is provided between the cover 23 and the tube 59 which joint includes a tube 85 and a gasket nut 87. The nut 87 is secured to the upper end of the tube 85 by a gas tight joint 87, such as a threaded joint, and is slidably mounted on the outer surface of the tube 59 by a gas-tight joint 91. Thus, when the tube 59 is raised or lowered, the atmosphere in the reaction area is uncontaminated by atmospheric gases such as oxygen and nitrogen.

In operation, when the magnesium 13 in the crucible 5 is melted, heat radiates through the retort bottom wall 21 (FIG. 1) as well as through the conduit 9 to vaporize a mass 93 of zirconium tetrachloride ($ZrCl_4$) within the retort 7. The $ZrCl_4$ is preferably in powdered form and vaporizes at about 331° C. As the volume of the vapor increases, it fills the chamber of the retort 7 where it is confined until all of the magnesium metal 13 is completely melted at about 700° C., when the conditions are conducive to a satisfactory reaction between the magnesium and the zirconium tetrachloride vapor. As the seal between these reactants is severed by cutting the diaphragm 33, the vapor descends through the conduit 9 into the crucible 5. The resulting reaction is in accordance with the formula:

$$ZrCl_4 + 2\ Mg \rightarrow Zr + 2\ MgCl_4$$

The resulting zirconium is in the form of zirconium sponge which settles to the bottom of the crucible 5 with any remaining magnesium and magnesium tetrachloride being disposed above a resulting body of zirconium sponge.

Accordingly, the apparatus of this invention provide means for producing zirconium sponge with the resulting formation of magnesium chloride and thereby avoiding the formation of subchlorides, such as $ZrCl_2$, which form at lower temperatures than in the temperatures range of 650° to 700° C. in accordance with this invention. It is necessary to avoid the formation of such subchlorides because of their highly pyrophoric characteristics and thereby avoid a fire hazard which is a constant consideration throughout the process of reducing zirconium from the zirconium chloride to the elemental state. Finally, it is emphasized that magnesium is completely melted before the reaction commences so that the pyrophoric zirconium dichloride formation is avoided.

What is claimed is:

1. Apparatus for reacting chemicals, comprising:

(a) retort means for containing a first reactant;

(b) crucible means for containing a second reactant;

(c) passage means interconnecting the retort means and the crucible means;

(d) means for heating at least one of the reactants to a predetermined temperature;

(e) wall means between the retort meand and crucible means for transmitting heat therebetween by radiation;

(f) closure means in the passage means for preventing interaction between the reactants and including a diaphragm extending across the passage means in a fluid-tight manner; and (g) opening means for opening the closure means to effect interreaction of the reactants at the predetermined temperature and including cutter means for movement against and severance of the diaphragm.

2. The apparatus of claim 1 in which the passage means comprises a tube extending between the retort means and the crucible means, the tube having a peripheral flange at one end, a clamping ring detachably mounted on the flange, the flange and the ring having annular interfitting means for clampingly holding the diaphragm in a fluid-tight manner across the tube.

3. The apparatus of claim 2 in which the cutter means comprises a blade proximate to the diaphragm, and cutting means for lifting the blade into the diaphragm.

4. The apparatus of claim 3 in which the cutting means comprises a blade-carrying arm movably mounted to rotate the blade in a circle into the diaphragm.

5. The apparatus of claim 4 in which the diaphragm is comprised of metal.

6. The apparatus of claim 4 in which the first reactant is $ZrCl_4$ and the second reactant is magnesium.

7. The apparatus of claim 6 in which the predetermined temperature ranges from about 650° C. to 700° C.

* * * * *